US005359943A

United States Patent [19]

Stahlecker et al.

[11] Patent Number: 5,359,943

[45] Date of Patent: Nov. 1, 1994

[54] APRON TABLE ARRANGEMENT FOR A DRAFTING UNIT

[75] Inventors: Hans Stahlecker, Süssen; Norbert Barauke, Donzdorf, both of Germany

[73] Assignee: Spindelfabrik Suessen, Schurr, Stahlecker & Grill GmbH, Suessen, Germany

[21] Appl. No.: 871,096

[22] Filed: Apr. 20, 1992

[30] Foreign Application Priority Data

Jul. 11, 1991 [DE] Germany ..... 4122881

[51] Int. Cl.[5] ..... A47B 13/08; B65D 85/66

[52] U.S. Cl. ..... 108/90; 206/389

[58] Field of Search ..... 108/90, 152, 161, 50, 108/69, 94; 206/389, 391, 393, 409, 397, 408, 412, 53

[56] References Cited

U.S. PATENT DOCUMENTS 4,550,666 11/1985 Svoboda ..... 100/9 X

FOREIGN PATENT DOCUMENTS 2310105 2/1975 Germany .

*Primary Examiner*—Jose V. Chen

*Attorney, Agent, or Firm*—Evenson, McKeown, Edwards & Lenahan

[57] ABSTRACT

In order to avoid a damaging of the guiding table and of the bottom apron guided around it when a lap formation occurs on the bottom delivery roller of a drafting unit, it is known to arrange the table top of the guiding table so that it can be swivelled away. In this known construction, a leaf spring is provided which holds the table top in its swivel position. In order to ensure a secure and precise guiding during the swivel movement of the table top, the new apron table is constructed with a projection which is provided on both sides with opposite surfaces which are positively guided during a swivel movement of the table top in a receiving device developed as a connecting link guide.

18 Claims, 5 Drawing Sheets

21
14
34
20
12
37
28
9
27
36
38
35
22
19"
26
25
19
23
19'
33
24
32
50

APRON TABLE ARRANGEMENT FOR A DRAFTING UNIT

BACKGROUND AND SUMMARY OF THE INVENTION

This invention relates to an apron table arrangement for a drafting unit, comprising a guiding table which carries at least one bottom apron and which is provided with a table top which can be swivelled away from a bottom delivery roller.

From the German Patent Document DE-AS 23 10 105, an apron table arrangement of the above-mentioned type is known which is provided with a table top which can be swivelled away from the bottom delivery roller. By means of the swivel arrangement of the table top, it is to be achieved that in the case of a lap formation at the bottom delivery roller, damage to the apron table or to the bottom apron and running disturbances are avoided. These occur particularly when a bottom apron arranged close to the bottom delivery roller comes in contact with a lap formed at the bottom delivery roller. In the above-mentioned patent document, it is suggested that the table top is disposed in a socket of a bottom apron bridge in a swivelling manner by means of a projection formed in the area of this boundary edge. A leaf spring which is arranged on the underside of the table top reaches over a longitudinal shoulder of the bottom apron bridge in the manner of a clamp. When a lap is formed at the bottom delivery roller, this lap presses against the bottom apron and thus swivels the table top, which is arranged in a swivelling manner, and the bottom apron guided over it gradually away from the bottom delivery roller. By the force of this leaf spring, the table top which may be swivelled away, is held in an engagement with the bottom apron bridge during its swivel movement. The known arrangement has the particular disadvantage that the swivelling table top during its swivel movement is not guided sufficiently securely. Furthermore, the provided leaf spring requires increased constructional expenditures. Finally, fiber fly can easily catch in the area of the leaf spring.

It is an object of the invention to provide an arrangement of an apron table by means of which the secure guiding of the table top is ensured during its swivel movement.

In order to achieve this object, it is suggested according to the invention that the table top has a projection which is provided on both sides with respective opposite surfaces which are guided during the swivel movement of the table top in a positively locking manner in a receiving device constructed as a connecting link guide.

By means of the development according to the invention, it is achieved that the table top is guided precisely and securely during its swivel movement because of the positively locking guiding of the projection in the receiving device. A detaching or an undesirable shifting of the table top during the swivel movement is excluded as a result of the positively locking guiding. Furthermore, the arrangement according to the invention has the advantage that the table top of the apron able which carries the deflecting edge is swivelled away precisely corresponding to the thickness of the lap at the bottom delivery roller. Thus, the swivelling angle of the table top that can be swivelled away is a function of the respective thickness of the lap forming at the bottom delivery roller.

In a development of the invention, it is suggested that the opposite surfaces and the connecting link guide are configured in such a manner that a moving of the table top out of the receiving device is possible only after a swivelling of the table top. As a result, it is ensured that when a lap formation occurs on the bottom delivery roller, the table top that can be swivelled away is first held securely in the receiving device. Only after a swivelling of the projection about a predetermined angle, will it be easily possible to pull the projection with the table top connected with it out of the receiving device, and thus lift off the whole apron table arrangement. Subsequently, cleaning work can be carried out in an unhindered manner on the bottom delivery roller. The installation of the apron table takes place in the reverse manner in that the projection is introduced again into the corresponding receiving device.

In the case of a further development of the invention, the receiving device has curved guiding surfaces in its end area which are arranged opposite and at a distance from one another and which have a common center of curvature. Thus, this area of the receiving device is constructed with cylindrical surfaces which are arranged at a distance from one another and which have a common center of curvature. During the swivel movement of the table top, the corresponding opposite surfaces of the projection are guided on these guiding surfaces of the receiving device. Thus, the projection is moved along a curvature following the curved path of the guiding surfaces. This has the result that the table top does not carry out a linear movement but a swivel movement as long as the projection is moved along the curved guiding surfaces. So that the table top is swivelled away from the bottom delivery roller, the center of curvature of the guiding surfaces, which at the same time is also the swivelling point of the projection, must be arranged on the side of the projection which faces away from the bottom delivery roller. In order to permit the desired guiding within the guiding surfaces, the opposite surfaces of the projection must be adapted to the contour of the corresponding guiding surfaces. The projection therefore has opposite surfaces which rest against the guiding surfaces of the receiving device. Advantageously, the guiding surfaces are bounded on one side by a stop surface and on the other side by surface lines. At the surface lines, the guiding surface facing the bottom delivery roller changes into a plane guiding surface and the guiding surface facing away from the bottom delivery roller changes into a curved guiding surface. Thus the guiding surfaces on the side which faces the underside of the table top end in surface lines where one of the guiding surfaces leaves the radius of curvature. At this point, both guiding surfaces lose their guiding function for the projection, even though the curvature is continued at the supporting surface facing away from the bottom delivery roller. The guiding surfaces of the receiving devices may be constructed in a very short length. They may possibly be reduced almost to the surface lines themselves.

In an advantageous further development of the invention, it is provided that the course of the stop surface, of the guiding surfaces and of the supporting surface is constructed approximately in the shape of an S.

It is advantageous for the receiving device to be arranged in a holding device which is provided with an essentially horizontally extending supporting surface on which the table top rests with its underside in its operating position. This horizontally extending supporting surface secures the apron table additionally against a movement in the direction of the bottom delivery roller. It also supports the apron table against the pressure forces which act from the weighting arm onto the apron table.

In a further development of the invention, it is provided that the opposite surfaces of the projection are adapted to the corresponding guiding surfaces of the receiving device in such a manner that, in the operating position of the apron table, a front face of the projection rests against the stop surface of the receiving device. So that the apron table and the apron winding around it do not rest on the bottom delivery roller in the operating position, the swivel movement of the apron table in the direction of the bottom delivery roller must be limited. This is achieved by means of the stop surface provided in the receiving device on which the front face of the projection rests in the operating position. In this case, a type of construction is advantageous in which the front face of the projection is completely enclosed by the connection between the two guiding surfaces of the receiving device.

In a further development of the invention, it is provided that the guiding surfaces of the receiving device extend along the whole circumferential length of the opposite surfaces of the projection. As a result, a particularly good and uniform guiding is achieved during the swivel movement of the table top. It is a function of the length of the opposite surfaces which swivel angle results during the swivel movement. For the length of the swivel movement, the central angle which is formed by the circumferential lengths of the opposite surfaces of the projection is decisive, which central angle is specifically measured from the surface lines of the receiving device in the direction of the end of the projection. The opposite surfaces end where the radius of curvature is left. If the opposite surfaces, dimensioned according to the center angle formed by them, have different lengths, the swivel angle is determined by the smallest center angle which is formed by one of the two opposite surfaces. As soon as, during a swivel movement, that point of an opposite surface at which it leaves the radius of curvature exceeds the above-mentioned surface line of the assigned guiding surfaces of the receiving device, both opposite surfaces will no longer rest against the two guiding surfaces of the receiving device. As a rule, the stop can then, possibly after a transverse movement, be pulled out of the receiving device. Advantageously, the center angle of one of the opposite surfaces of the projection formed by the circumferential length is smaller than that of the other opposite surface. As mentioned above, the length of the swivel movement is a function of the shortest of the two opposite surfaces relative to the center angle formed by them. If the apron table is to be produced for a very specific swivelling angle, it is sufficient, when machining the stop, to take into account only one, specifically the shorter of the two opposite surfaces. Since the other opposite surface does not have to be taken in account with respect to its length, the manufacturing expenditures are reduced.

In an advantageous further development of the invention, it is provided that the center of curvature is situated between connecting lines which extend from the center of the bottom apron roller to the deflecting edge of the table top in the operating condition and in the swivelled-up condition. In the operating condition, the connecting line will then be situated between the deflecting edge and the center of the bottom apron roller below the center of curvature. The bottom apron is made of a material which has a certain elasticity and permits a linear expansion. During the operating condition, the bottom apron is tensioned in itself because of its elasticity. As a result of the fact that the swivel point of the projection during the operating condition is situated above the connecting line between the deflecting edge and the center of the bottom apron roller, the apron table is held in its operating position because of the tension of the apron.

Advantageously, the projection can be constructed in one piece with the table top and can be molded onto it. This reduces manufacturing expenditures. In addition to the lower manufacturing expenditures, the further advantage is achieved that unnecessary edges at which fiber fly may collect are avoided. Expediently, the table top and the projection may be made of plastic. It is possible to produce the profile for the table top and the projection in a length of several meters and then cut the table top with the projection in each case in the required length off this longitudinal profile made of plastic. Since, in contrast to the known constructions, additional components, such as leaf springs and screws, are not required, the manufacturing of such an apron table is particularly simple. Naturally, instead of the plastic material, another material may be advantageously used by means of which the manufacturing of the profile is possible in a simple and cost-efficient manner.

It is advantageous, during the operating condition, for an element of the weighting arm to rest with spring pressure against the table top. It is known that during the operating condition the top aprons rest against the bottom aprons, the top aprons being spring elastically disposed in the weighting arm. If the apron table extends in the longitudinal direction of the machine along several drafting units, for example, along the two drafting units of a twin drafting unit, it may be provided that a cage support of the weighting arm presses directly against the apron table between two drafting units.

In a further development of the invention, it is provided that a common table top is provided for several drafting units arranged next to one another in the longitudinal direction of the machine. Since, in the case of such a development of the invention, a separate table top and separately provided holding elements are not provided for each individual spinning unit, the manufacturing expenditures are reduced.

In a further development of the invention, it is provided that at least two holding devices are provided for one table top which are arranged at a distance from one another and which are each equipped with receiving devices for the projections of the table top. It is advantageous in this case for a holding device to be provided at least at each front face of the table top extending along several drafting units. In this case, it is particularly expedient for the spacing of the table tops to correspond to the spacing of the drafting unit system in the longitudinal direction of the machine. Conventionally, two adjacent drafting units respectively are manufactured as so-called twin drafting units, a weighting arm being provided for one twin drafting unit which receives the top rollers for both drafting units of the twin drafting unit. It is therefore particularly expedient for one table top to be provided for each twin drafting unit for the two drafting units belonging to the twin drafting units.

It is advantageous for the holding devices to have an approximately U-shaped design, the receiving devices for the projection being developed on at least one of the legs. In this case, it may advantageously be provided that the respective outer legs reach around the edge faces of the table top, and the inner legs are constructed with receiving devices having guiding surfaces. By the reaching around the edge faces of the table tops, it is achieved that a shifting of the table top, which otherwise is held only by the guiding surfaces of the receiving devices, is prevented in the longitudinal direction. Additional fastening elements for the table top are not required.

It is advantageous for the holding devices to be detachably fastened on a bearing rail extending along several spinning stations. Conventionally, it was customary to arrange the apron tables along a length between two roller stands and to fasten them to the roller stands, for example, screw them on. In the case of a lap formation on one of the bottom delivery rollers between the roller stands, for the elimination of the fault, all drafting units had to be stopped between two roller stands, so that the apron table could be removed and the disturbance could be eliminated. In the case of the further development suggested here, the table top is no longer, as customary, fastened to the roller stands, but on holding devices which, in turn, are fastened on a bearing rail. This bearing rail extends between two roller stands and is advantageously fastened to the bearing carriages for the bottom apron roller. This arrangement permits the arranging of several table tops between two roller stands which are each assigned to individual or to a small group of drafting units, particularly in each case to one twin drafting unit and are each guided in holding devices which, in turn, are detachably fastened on the bearing rail.

In a further development of the invention, it is provided that the holding devices, on the sides facing the bearing rail, have lappings which partially reach around the bearing rail while forming a form closure.

Other objects, advantages and novel features of the present invention will become apparent from the following detailed description of the invention when considered in conjunction with the accompanying drawings.

DETAILED DESCRIPTION OF THE DRAWINGS

Figure 1:
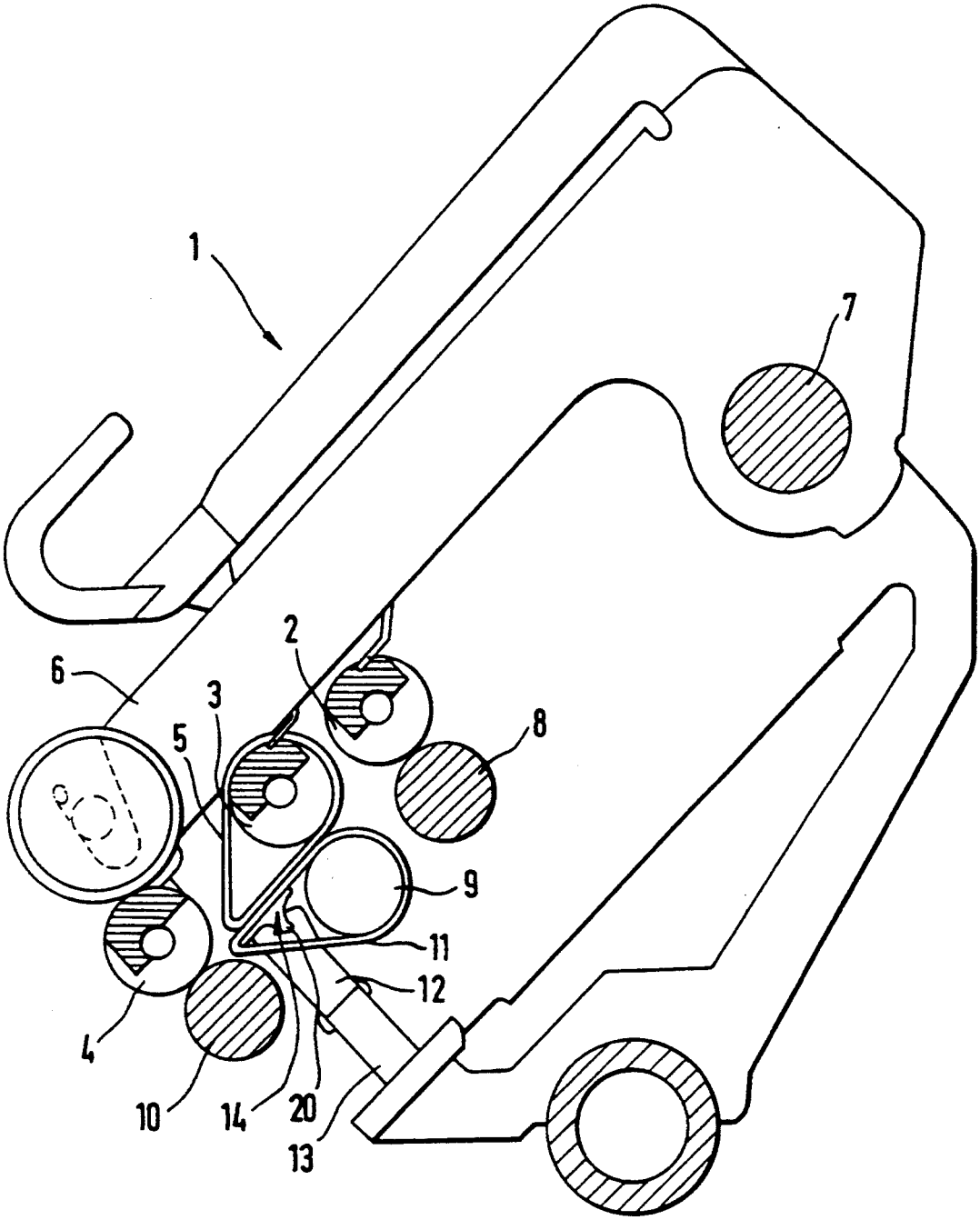
FIG. 1 is a cross-sectional view of a drafting unit with an apron table arrangement constructed according to a preferred embodiment of the invention.
Figure 2:
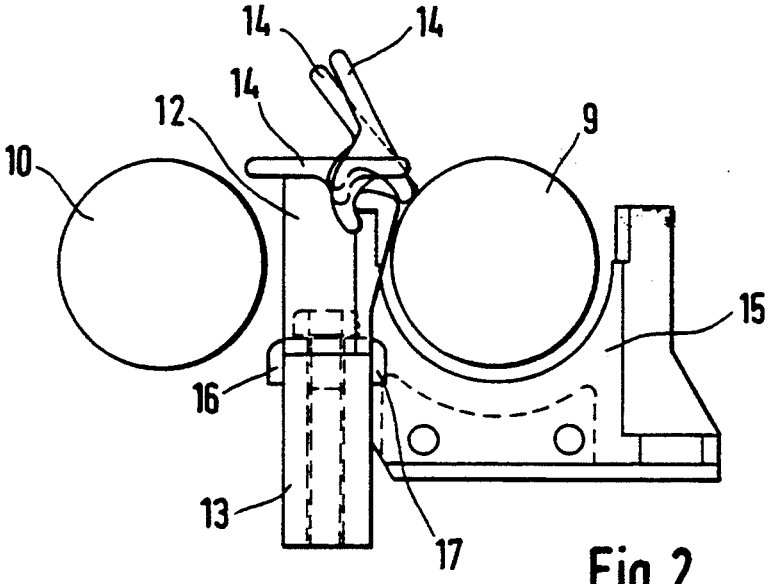
FIG. 2 is an enlarged cutout of FIG. 1 of the drafting unit with the apron table and two bottom rollers.

FIG. 1 is a schematic cross-sectional representation of a conventional drafting unit with an apron table arrangement according to the invention, in which case the components which are not required for understanding the invention are not shown.

In the case of a spinning machine, a plurality of such drafting units 1 is arranged on both sides of the machine in the longitudinal direction of the machine. In the longitudinal direction, the machine is divided by so-called roller stands, which are not shown, and which serve as bearing elements for a plurality, usually between eight and twelve, mutually adjacent drafting units 1. The roller stands, which are arranged in the longitudinal direction of the machine at a distance from one another, comprise bearing carriages for the bottom rollers 8, 9, 10 of the drafting units 1, these bottom rollers 8, 9, 10 extending along the whole length of the machine and being driven from the machine head. These continuous bottom rollers 8, 9, 10, which are arranged in parallel to one another according to FIG. 1 in the area of the drafting units 1, are as a rule each provided with surface profilings. These surface profilings are to have the effect that the fed sliver in the desired manner is conveyed through the drafting unit and is drafted correspondingly.

The drafting unit 1 illustrated in FIG. 1 comprises the continuous bottom rollers 8, 9, 10 which are driven from the machine head. The top rollers 2, 3, 4 are in a frictional contact with these bottom rollers 8, 9, 10 and are driven by them. The center rollers 3, 9 are equipped with aprons 5, 11, apron 5 being called the top apron and apron 11 being called the bottom apron. Thus, these center rollers 3, 9 do not rest directly against one another, but rather against the aprons 5, 11 carried by them. The top rollers 2, 3, 4 are elastically arranged in a weighting arm 6 which can be swivelled about a swivel shaft 7 arranged in the longitudinal direction of the machine. In a conventional manner, two adjacent drafting units 1 are combined as a twin drafting unit so that two adjacent sets of top rollers 2, 3, 4 respectively are received by the weighting arm 6.

The top apron 5 is wound around the center top roller 3 and is guided in a top apron cage which is not shown in the drawing. The bottom apron 11 is wound around the bottom apron roller 9 and is guided over an apron table 14 to shortly in front of a wedge-shaped gap formed by the delivery rollers 4 and 10. At the wedge-shaped gap formed by the delivery rollers 4, 10, the apron table 14 is used as a deflecting edge 42 (compare FIG. 7) for the bottom apron 11. The apron table 14 is accommodated in the receiving device 50, which is constructed as a connecting link guide and will be described in detail below, of a holding device 12. Holding device 12 is in turn screwed or bolted to a bearing rail 13 which extends between two roller stands and there is fastened to the bearing carriages for the bottom apron rollers 9.

Figure 4:
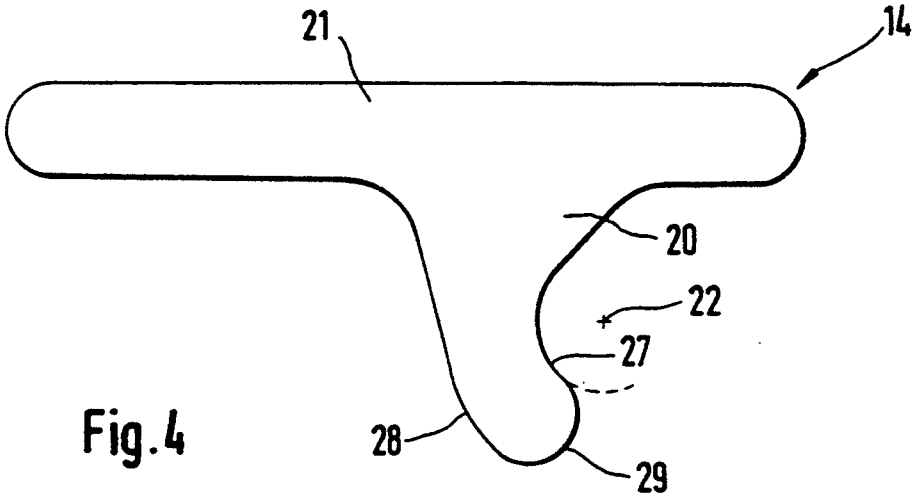
FIG. 4 is a lateral view of an enlarged representation of an apron table, constructed according to a preferred embodiment of the invention.

The apron table 14 essentially comprises a table ted 21, on the top side of which the bottom apron 11 is guided, and a projection which is approximately perpendicularly arranged on the underside 34 of the table top 21 (compare FIG. 4). The projection 20 is partially received by the receiving device 50 of the holding device 12, which will be described below.

Figure 3:
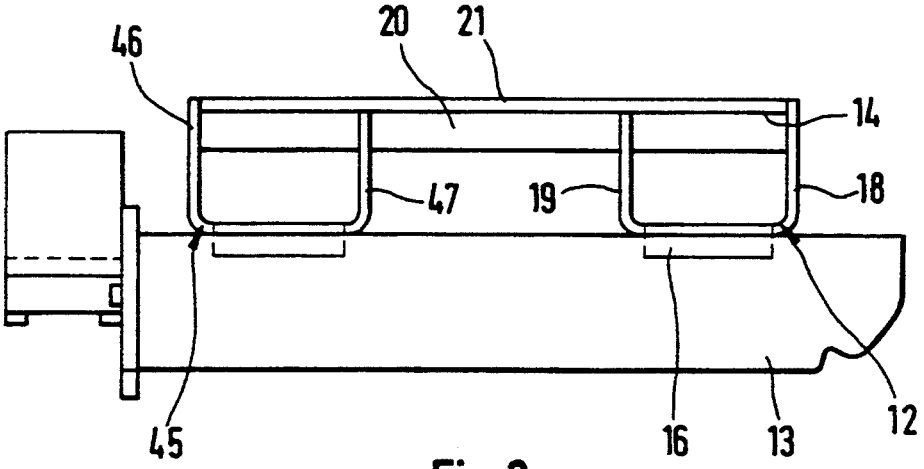
FIG. 3 is a frontal view of an apron table for two adjacent drafting units with holding devices, constructed according to a preferred embodiment of the invention.

As shown in FIG. 3, two adjacent holding devices 12, 45 are provided for the apron table 14. These two adjacent holding devices 12, 45 are screwed to bearing rails 13, overlappings 16, 17 being provided on the holding devices 12, 45 which reach around the upper edges of the bearing rail 13. By means of the overlapping elements 16, 17, together with the screwed connections, a simple and secure fastening of the holding devices 12, 45 on the bearing rail 13 is achieved. The apron table 14 illustrated in FIG. 3 extends along two adjacent spinning stations and is used as an apron guide for the two adjacent bottom rollers 9 of a twin drafting unit.

The holding devices 12, 45 are composed in the same manner and are arranged mirror-invertedly with respect to one another on the bearing rail 13. In this case, holding device 12 has an outer leg 18 and an inner leg 19. Correspondingly, holding device 45 has an outer leg 46 and an inner leg 47. The inner legs 19, 47 have a contour, as shown, for example, in FIG. 5. They therefore each comprise a receiving device 50 for the projection 20 of the apron table 14. In contrast, the outer legs 18, 46 have no receiving devices of this type. As indicated in FIG. 3, the outer legs 18, 46 each reach around the edge faces of the apron table 14 so that its shifting in the longitudinal direction is avoided. The hollow spaces bounded by the legs 18, 19 and 46, 47 are each also used as a lateral guide for the bottom aprons 11 which are guided through these hollow spaces. As also shown in FIG. 3, the bearing rail 13 extends along more than two spinning stations and can receive further holding devices for apron tables. The holding devices 12, 45 can easily be removed from the bearing rail 13 by an unscrewing of the screwed connection.

Figure 5:
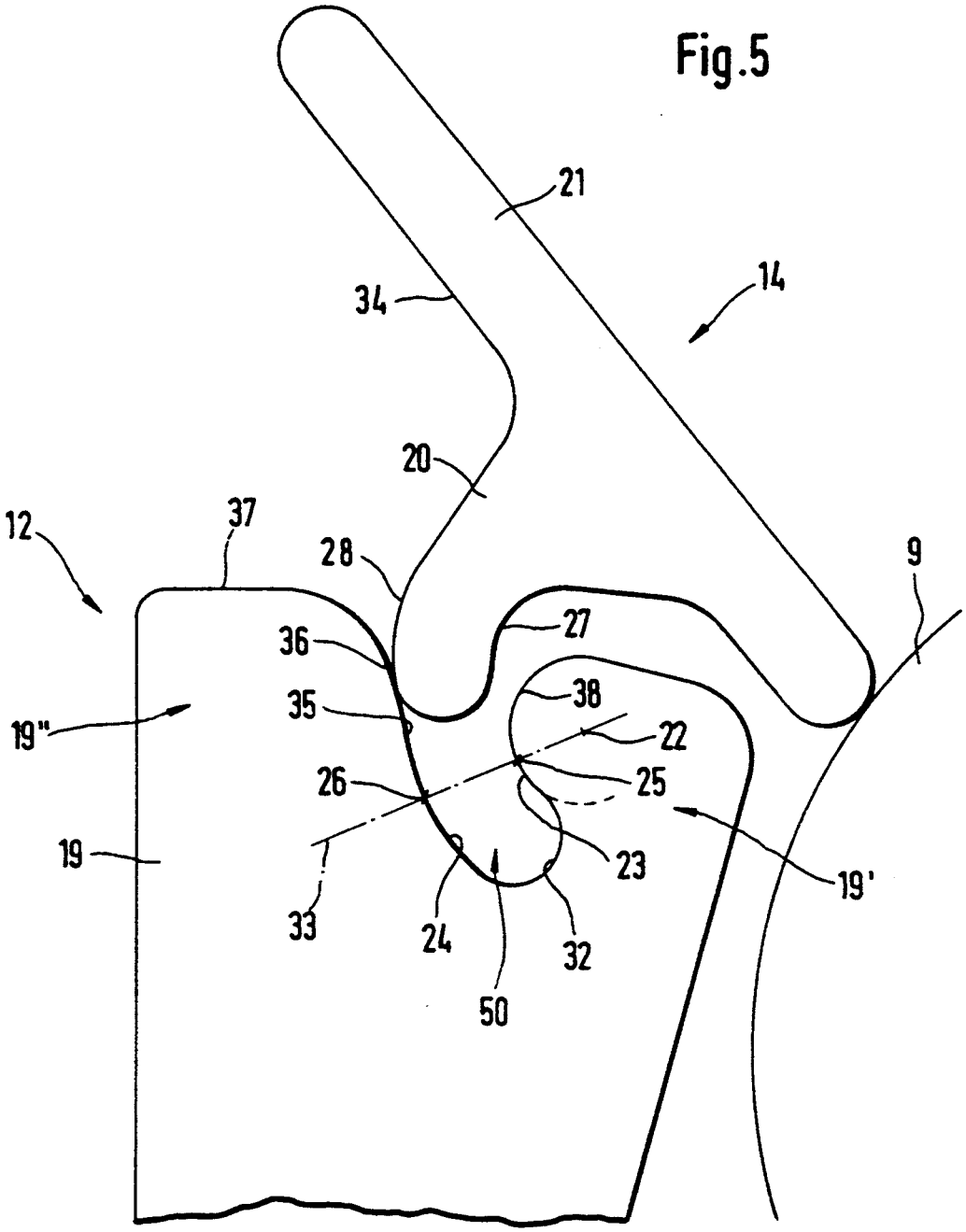
FIG. 5 is an enlarged representation of a lateral view of the apron table of FIGS. 1–4 lifted off the holding device.

As indicated in FIG. 5, the leg 19 of the holding device 12 is provided with the receiving device 50. The leg 19 is constructed as a connecting link guide and its receiving device 50 comprises guiding surfaces 23, 24 which are arranged as cylindrical surfaces about a center of curvature 22. These cylindrical guiding surfaces 23, 24 end on the side of the receiving device 50 which faces the table top 21 at the surface lines 25, 26. In the closed end area of the receiving device 50, which is arranged on the bottom in FIG. 5, the guiding surfaces 23, 24 are connected with one another by an also curved stop surface 32. Above the surface line 25, a supporting surface 38 is connected to the guiding surface 23 which is constructed with the same curvature. In contrast, the oppositely arranged guiding surface 24 changes into a plane surface 35 above the surface line 26.

Figure 7:
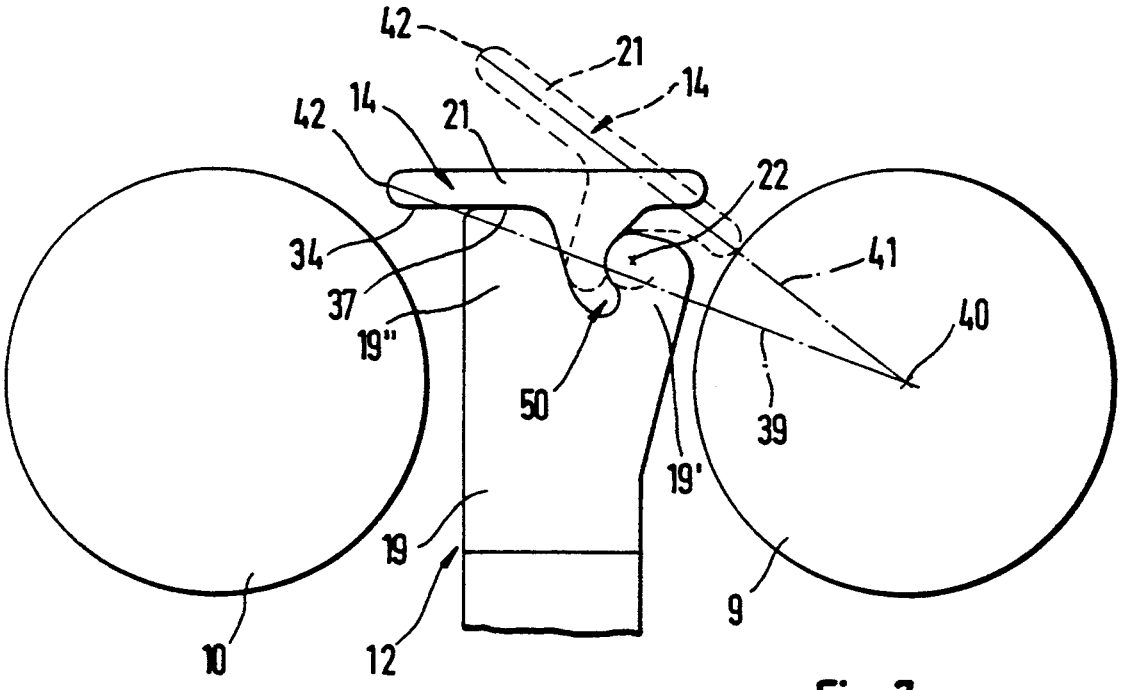
FIG. 7 is a schematic view of a holding device with an apron table according to FIGS. 1–6 in the operating position and in the swivelled-up position.

Accordingly, the course of the stop surface 32 of the connecting guiding surface 23 and of the supporting surface 38 are constructed approximately in an S-shape. As indicated in FIG. 7, the center of curvature 22 is situated between connecting lines 39 and 41 which extend from the center 40 of the bottom apron roller 9 to the deflecting edge 42, 43 of the table top 21 in the operating condition and in the swivelled-up condition. The position of the apron table 14 in the swivelled-up condition is shown in FIG. 7 by an interrupted line. In this case, the center of curvature 22 is arranged in an area 19' of the leg 19 of the holding device 12 which faces the roller 9.

As shown in FIG. 5, the receiving device 50 is arranged in a holding device 12 which is provided with a supporting surface 37 on which the table top rests 21 in its operating position by means of its underside 34.

Figure 6:
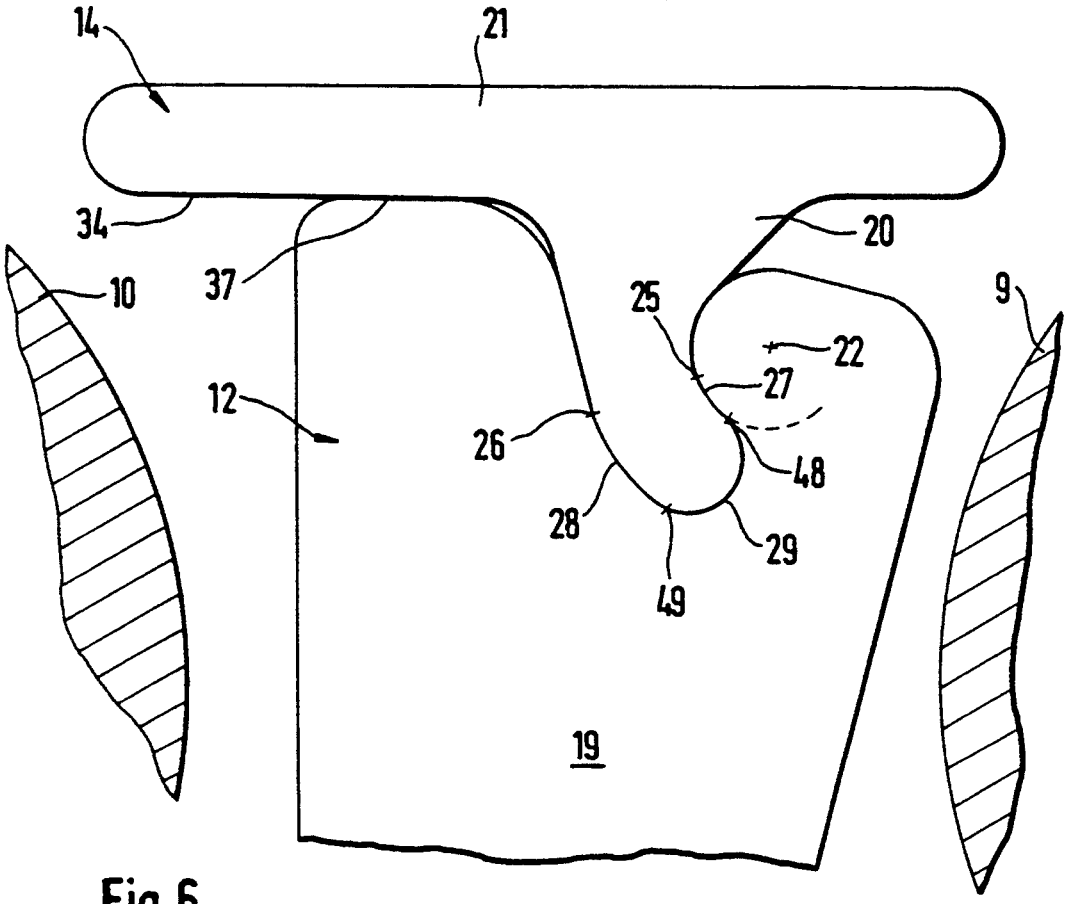
FIG. 6 is a view of the apron table of FIG. 5 in a position in which it is lowered into the receiving device.

Corresponding to the guiding surfaces 23, 24 of the receiving device 50, opposing guide surfaces 27, 28 are arranged on the projection 20 of the apron table 14 which have the same course of curvature as the corresponding guiding surfaces 23, 24. As shown in FIG. 4, the opposing guide surfaces 27, 28 also extend about the center of curvature 22. FIG. 6 illustrates the circumferential length of the opposing guide surfaces 27, 28. In this representation, the guiding table 14 is in its operative position. In this case, the table top 21 is lowered completely, in which case the opposing guide surfaces 27, 28 of the projection 20 are completely accommodated in the receiving device 50. The receiving device 50, which is bounded by the guiding surfaces 23, 24, is bounded on its closed end by the curved stop surface 32 against which the front face 29 of the projection 20 rests. As indicated in FIG. 6, the projection 20, conforms with its opposing guide surfaces 27, 28 and its front face 29 completely to the guiding surfaces 23, 24 and the stop surface 32 of the recess 50.

At point 48, the opposing guide surface 27 of the projection 20 changes its direction of curvature and leaves the radius of curvature. Likewise, the opposing guide surface 28, at point 49, leaves the radius of curvature and changes to the front face 29. The opposing guide surface 27 therefore starts with the surface line 25 and ends at point 48. Correspondingly, the opposing guide surface 28 starts with the surface line 26 and ends at point 49.

In the following, the method of operation of the above-described apron table 14 will be described. If an undesirable lap formation occurs in the area of the bottom roller 10, the apron table 14 is swivelled away from the bottom roller 10 clockwise. The bottom apron 11 guided around the apron table 14 also carries out a swivel movement. In this case, the swivel position is a function of the extent of the lap formation on the bottom roller 10. During the swivel motion, the apron table 14, by means of the projection 20 connected with it, is guided securely and precisely on the receiving device 50 of the holding device 12. In this case, the opposing guide surfaces 27, 28 slide over the corresponding guiding surfaces 23, 24 of the receiving device 50. The surfaces 35 and 38 arranged above the surface lines 25, 26 are used only as supporting surfaces for the absorption of forces which act in the direction of the bottom delivery roller 10 or the bottom apron roller 9. Although the projection 20 also rests firmly against the surfaces 35 and 38 of the receiving device 50, the surfaces 35 and 38 should not be regarded as guiding surfaces because they have no influence on the swivel movement of the projection 20.

Figure 8:
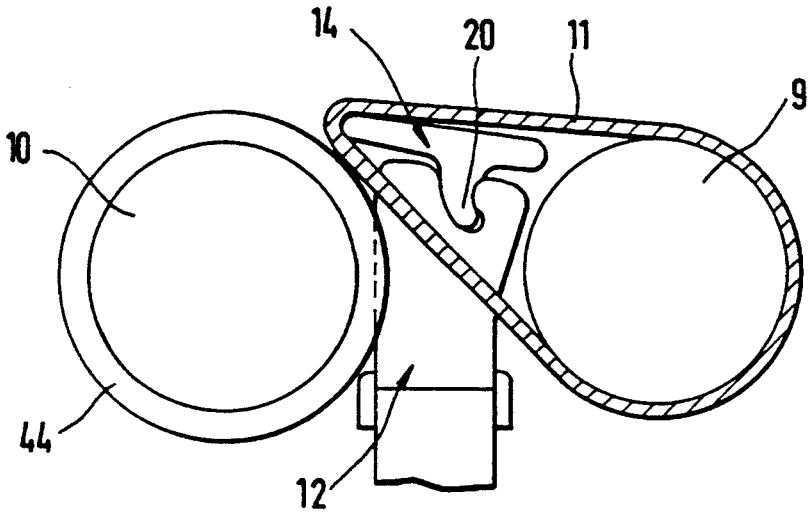
FIG. 8 is a schematic view of the apron table of FIGS. 1–7 in a slightly swivelled-away position which is caused by lap formation.

FIG. 8 illustrates how the apron table 14 is swivelled away in the case of a lap formation on the bottom delivery roller 10. In FIG. 8, a lap has formed on the circumference of the bottom delivery roller 10 which has the reference number 44. This lap 44 presses against the bottom apron 11, whereby the apron table 14 is caused to swivel slightly away from the bottom delivery roller 10. By means of this swivelling, it is permitted that, in the case of a lap formation, no excessive pressures are generated in the area of the bottom delivery roller 10 and of the bottom apron 11 or of the apron table 14 which may damage the apron table 14 and result in considerable operating disturbances. In the operating condition, the top apron 5 (compare FIG. 1) rests on the bottom apron 11. Since the top apron 5 is spring-elastically held in the weighting arm 6, it yields correspondingly during a swivel movement of the bottom apron 14. As indicated, the projection 20 of the apron table 14 is still situated within the receiving device 50 of the holding device 12. Accordingly, the apron table 14 can not yet be detached from the holding device 12 because the projection 20 has not yet swivelled far enough clockwise inside the receiving device 50. For the demounting of the apron table 14, it must be swivelled farther by hand, approximately into the position which is shown by an interrupted line in FIG. 7. In this position, the projection 20 can easily be removed from the receiving device 50 of the holding device 12 in a straight direction.

In practice, a swivel movement is desirable which first does not permit a detaching of the apron table 14 from the holding device 12. When a lap 44 is formed on the bottom delivery roller 10, the apron table 14 must be lifted off the bottom delivery roller 10 corresponding to the diameter of the lap but must not be pushed out of the holding device 12 or out of the receiving device 50 in an uncontrolled manner. On the contrary, the lifting-out should be possible only after a further manual swivelling. The above-described guiding of the apron table 14 permits a precise swivel movement at an angle that is to be determined ahead of time as well as a subsequent lifting-out of the apron table 14. Since the contour of the rear side of the projection 20 corresponds essentially to the contour of the receiving device 50 of the holding device 12 in the rear area, the apron table 14, after the lowering and after the lifting-out from the recess 50, can be placed on this rear part of the holding device 12.

FIG. 7 illustrates the dead center formed by the swivel shaft 22 in connection with the bottom apron 11. In the operating position, the apron table 14 is swivelled away toward the bottom delivery roller, the bottom side 34 of the table top 21 resting on the horizontal supporting surface 37 of the holding device 12. In the operating condition, the tensioned bottom apron 11 extends along the deflecting edge 42. Since the straight line 39 formed between the center 40 of the bottom apron roller 9 and the deflecting edge 42 extends below the swivel point 22, the apron table 14 is held in its operating position by the tension of the bottom apron 11. In FIG. 7, this operating position is entered by drawn-out lines while the swivelled-away position is illustrated by a interrupted lines. In this position, a straight line 41 is formed between the deflecting edge 42 and the center 40 of the bottom apron roller 9 which extends above the swivel point 22. The bottom apron 11 can therefore not pull the apron table 14 out of the swivelled-away position into the operating position.

The one-piece apron table 14, to which the hook-shaped projection 20 is molded, may be manufactured from plastic in a simple and cost-effective manner. In particular, it is possible to cut apron tables 14 of the respective desired width off a plastic profile which has a cross-section of this type.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A drafting unit for a textile machine, comprising:

a first bottom roller mounted to the drafting unit;

a second bottom roller mounted to the drafting unit and disposed downstream of the first bottom roller with respect to sliver being drafted during operation of the drafting unit;

a guiding table disposed between the first and second bottom rollers, said table including a table top and a downwardly extending hook shaped projection;

a bottom apron wound around the first bottom roller and guided over the table top; and a table holder mounted to the drafting unit and having a guide slot which guidably engages the hook shaped projection to support the table;

wherein the guide slot and hook shaped projection have respective curved guide surfaces engaged with one another to control relative movement of the table and holder during operations with lap formation at the second bottom roller pushing the downstream end of the table upwardly, said curved guide surfaces engaging one another to guidable control pivotal movement of the table during drafting operations from a first bottom position of the downstream end of the table to a second raised position of the downstream end of the table, said curved guide surface being configured to prevent separation of the table and table holder during pivotal movement between said first and second positions while permitting separation of the table and holder when the table is pivoted upwardly beyond the second position.

2. A drafting unit according to claim 1, wherein the curved guide surfaces of the guide slot are located in a lower closed end area of the guide slot and include mutually opposite, spaced, curved guiding surfaces which have a common center of curvature.

3. A drafting unit according to claim 2, wherein the curved guide surfaces of the guide slot include:

a curved stop surface against which a front face of the projection rests when the table is in its first bottom position, a first guide surface extending from the stop surface and facing toward the second bottom roller, and a second guide surface extending from the stop surface and facing away from the second bottom roller.

4. A drafting unit according to claim 3, wherein the first guide surface includes a first curved section extending from the stop surface to a separation point and a second curved section extending upwardly from the separation point, said first and second guide surfaces having centers of curvature at respective opposite sides of the first guide surface to thereby provide an approximately S-shape to the first guide surface and stop surface.

5. A drafting unit according to claim 4, wherein the second guide surface includes a first curved section extending from the stop surface to a separation point and a second substantially planar guiding surface at a side of the separation point opposite the stop surface.

6. A drafting unit according to claim 2, wherein the common center of curvature is situated between a first line which extends from a center of the first bottom roller to the downstream end of the table when in the first bottom position and a second connecting line which extends from the center of the first bottom roller and the downstream end of the table when in the second raised position.

7. A drafting unit according to claim 1, wherein the table holder is provided with an essentially horizontally extending supporting surface on which the table rests with its bottom side when the table is in the first bottom position.

8. A drafting unit according to claim 1, wherein the guide surfaces of the guide slot extend along a whole circumferential length of opposing guide surfaces of the projection when the table is in the first bottom position.

9. A drafting unit according to claim 1, wherein the projection is constructed in one piece with the table top and is molded onto it.

10. A drafting unit according to claim 1, wherein the table top and the projection are made of plastic.

11. A drafting unit according to claim 1, further comprising a weighting arm and a spring device for pushing the weighting arm against the guiding table with spring pressure during drafting operations.

12. A drafting unit according to claim 1, wherein the guiding table is a common guiding table for a plurality of drafting units arranged next to one another in a longitudinal direction of a spinning machine.

13. A drafting unit according to claim 12, wherein said table holders are detachably fastened to a bearing rail extending along several spinning stations.

14. A drafting unit according to claim 13, wherein the bearing rail is fastened to bearing carriages for the first bottom roller.

15. A drafting unit according to claim 13, wherein the table holders have extensions reaching partially around the bearing rail while forming a form closure.

16. A drafting unit according to claim 1, wherein said guiding table includes two hook shaped projections, and wherein two of said table holders are arranged at a distance from one another, each of said table holders being provided with one of said guide slots which guidably engages a respective one of said hook shaped projections.

17. A drafting unit according to claim 16, wherein the table holders each have an approximately U-shaped design with two legs, the guide slot being formed in one of the legs of the U.

18. A drafting unit according to claim 17, wherein respective outer legs of the table holders extend around edge faces of the table top, and respective inner legs contain the guide slots.

* * * * *